US005461801A

United States Patent [19]

Anderton

[11] Patent Number: 5,461,801

[45] Date of Patent: Oct. 31, 1995

[54] CLEATED ATHLETIC SHOE WITH CRISSCROSS ARCH REINFORCEMENT

[76] Inventor: Graeme Anderton, 7862 SW. 27th, Portland, Oreg. 97219

[21] Appl. No.: 108,432

[22] Filed: Aug. 18, 1993

[51] Int. Cl.[6] ..... A43B 11/00; A43B 5/02; A43B 5/00; A44B 9/00

[52] U.S. Cl. ..... 36/114; 36/128; 36/134; 36/50.1; 24/713.4

[58] Field of Search ..... 36/133, 50.1, 126, 36/127, 128, 129, 134, 114; 24/713.4

[56] References Cited

U.S. PATENT DOCUMENTS

| | | | |
|---|---|---|---|
| 3,328,901 | 7/1967 | Strickland | 36/59 |
| 3,352,034 | 11/1967 | Braun | 36/67 |
| 3,513,571 | 5/1970 | Larcher | 36/67 |
| 3,577,663 | 5/1971 | Mershon | 36/67 |
| 4,085,526 | 4/1978 | Hemmer | 36/59 |
| 4,107,858 | 8/1978 | Bowerman et al. | 36/134 |
| 4,194,310 | 3/1980 | Bowerman | 36/128 |
| 4,255,876 | 3/1981 | Johnson | 36/83 |
| 4,327,503 | 5/1982 | Johnson | 36/32 |
| 4,398,358 | 8/1983 | Hilton | 36/114 |
| 4,413,431 | 11/1983 | Cavanagh | 36/114 |
| 4,454,662 | 6/1984 | Stubblefield | 36/91 |
| 4,492,047 | 1/1985 | Arff | 36/134 |
| 4,553,342 | 11/1985 | Derderian et al. | 36/97 |
| 4,670,949 | 6/1987 | Autry | 24/140 |
| 4,676,011 | 6/1987 | O'Rourke et al. | 36/89 |
| 4,858,343 | 8/1989 | Flemming | 36/128 |
| 4,885,851 | 12/1989 | Peterson | 36/127 |
| 5,142,797 | 9/1992 | Cole, III | 36/113 |
| 5,351,421 | 10/1994 | Miers | 36/128 |

FOREIGN PATENT DOCUMENTS

| | | | |
|---|---|---|---|
| 2929365 | 2/1981 | Germany | 36/129 |
| 8200573 | 3/1982 | WIPO | 36/129 |

*Primary Examiner*—Paul T. Sewell
*Assistant Examiner*—BethAnne C. Cicconi
*Attorney, Agent, or Firm*—Senniger, Powers, Leavitt & Roedel

[57] ABSTRACT

A cleated athletic shoe having a crisscross arch reinforcement extending between selected cleats on the sole of the shoe. An athletic shoe having a lacing arrangement in which the series of eyelets on the instep portion of the shoe are asymmetrical with the series of eyelets on the outstep portion of the shoe.

17 Claims, 4 Drawing Sheets

CLEATED ATHLETIC SHOE WITH CRISSCROSS ARCH REINFORCEMENT

BACKGROUND OF THE INVENTION

This invention relates to a cleated athletic shoe for use in playing soccer, football, rugby and the like. In particular, the invention relates to a cleated athletic shoe having an improved sole and upper design providing enhanced stability and foot control and a secure and comfortable fit.

Cleated athletic shoes for playing soccer, football, rugby and the like should be durable and lightweight while still providing a snug and comfortable fit which supports and stabilizes the foot. Previous efforts at enhancing the stability of athletic shoes have resulted in staggered arrangements of lace openings such as described in Johnson, U.S. Pat. No. 4,255,876. Staggered lacing arrangements are also shown in Cavanaugh, U.S. Pat. No. 4,413,431, Derderian et al., U.S. Pat. No. 4,553,342 and Autry, U.S. Pat. No. 4,670,949. A disadvantage of these previous lacing arrangements, however, is that they fail to fully appreciate the differences between the instep and outstep of the foot directly underneath the lacing arrangement.

Other efforts at improving the stability and overall performance of cleated athletic shoes have involved the incorporation of reinforcing material across substantially the entire arch region of the sole as described in Stubblefield, U.S. Pat. No. 4,454,662. Flemming, U.S. Pat. No. 4,858,343, illustrates a different approach using a web reinforcement aligned diagonally across the bottom of the sole. Alternative reinforcement designs are desired, however, which provide a greater amount of added rigidity to the sole and added support to the arch region of the foot without excessively increasing the weight and bulk thereof.

SUMMARY OF THE INVENTION

It is an object of the invention, therefore, to provide a cleated athletic shoe which provides improved maneuverability, including stopping, starting and turning ability for sports such as soccer; to provide such a shoe having a relatively lightweight reinforced molded sole which provides improved support and reduces fatigue; to provide such a shoe having an upper design including a lace pattern which provides improved comfort and stability; to provide an upper design which provides improved comfort and stability for the instep and outstep of the foot taking into account the differences therebetween.

Briefly, therefore, this invention is directed to a cleated athletic shoe having a plurality of forward cleats, including a rearwardmost forward outer cleat adjacent the outer edge of the sole and a rearwardmost forward inner cleat adjacent the inner edge of the sole. The shoe further has a plurality of rearward cleats, including a forwardmost rearward outer cleat adjacent the outer edge of the sole and a forwardmost rearward inner cleat adjacent the inner edge of the sole. There is a crisscross arch reinforcement on the sole having first and second intersecting arch ribs. The first arch rib extends between the rearwardmost forward outer cleat and the forwardmost rearward inner cleat. The second arch rib extends between the rearwardmost forward inner cleat and the forwardmost rearward outer cleat.

The invention is further directed to an athletic shoe including an upper having first and second opposite side portions which overlie the tongue. There is a first series of eyelets for receiving a lace on the first side portion and a second series of eyelets for receiving the lace on the second side portion. The first series of eyelets is asymmetrical to the second series of eyelets with respect to the centerline of said tongue.

Finally, the invention is directed to a cleated athletic shoe having a plurality of forward cleats, including a rearwardmost forward outer cleat adjacent the outer edge of the sole, a rearwardmost forward inner cleat adjacent the inner edge of the sole, and a triangular forward outer cleat adjacent the outer edge of the sole having a flat edge aligned generally parallel to said outer edge of the sole. There are four rearward cleats, including a forwardmost rearward outer cleat, a forwardmost rearward inner cleat, a rearwardmost rearward outer cleat, and a rearwardmost rearward inner cleat, the rearwardmost rearward outer cleat being triangular. The shoe also includes a crisscross arch reinforcement on the sole having first and second intersecting arch ribs. The first arch rib extends between the rearwardmost forward outer cleat and the forwardmost rearward inner cleat. The second arch rib extends between the rearwardmost forward inner cleat and the forwardmost rearward outer cleat. There is also an outer sole arch reinforcement comprising a rib extending between the rearwardmost forward outer cleat and the forwardmost rearward outer cleat.

Other objects and features of the invention will be in part apparent and in part pointed out hereinafter.

DETAILED DESCRIPTION OF THE INVENTION

Figure 1:
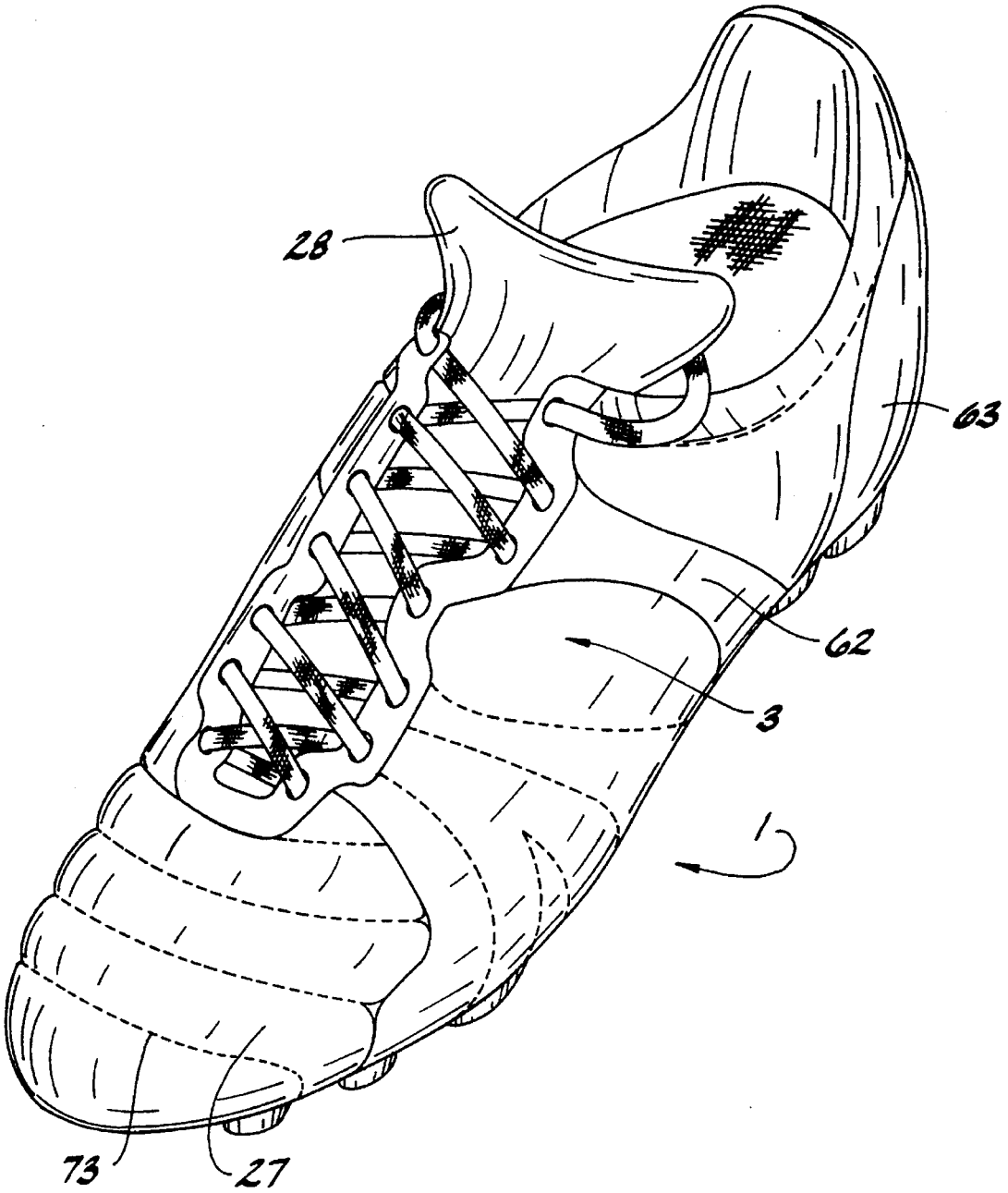
FIG. 1 is a perspective of the cleated athletic shoe of the invention.
Figure 2:
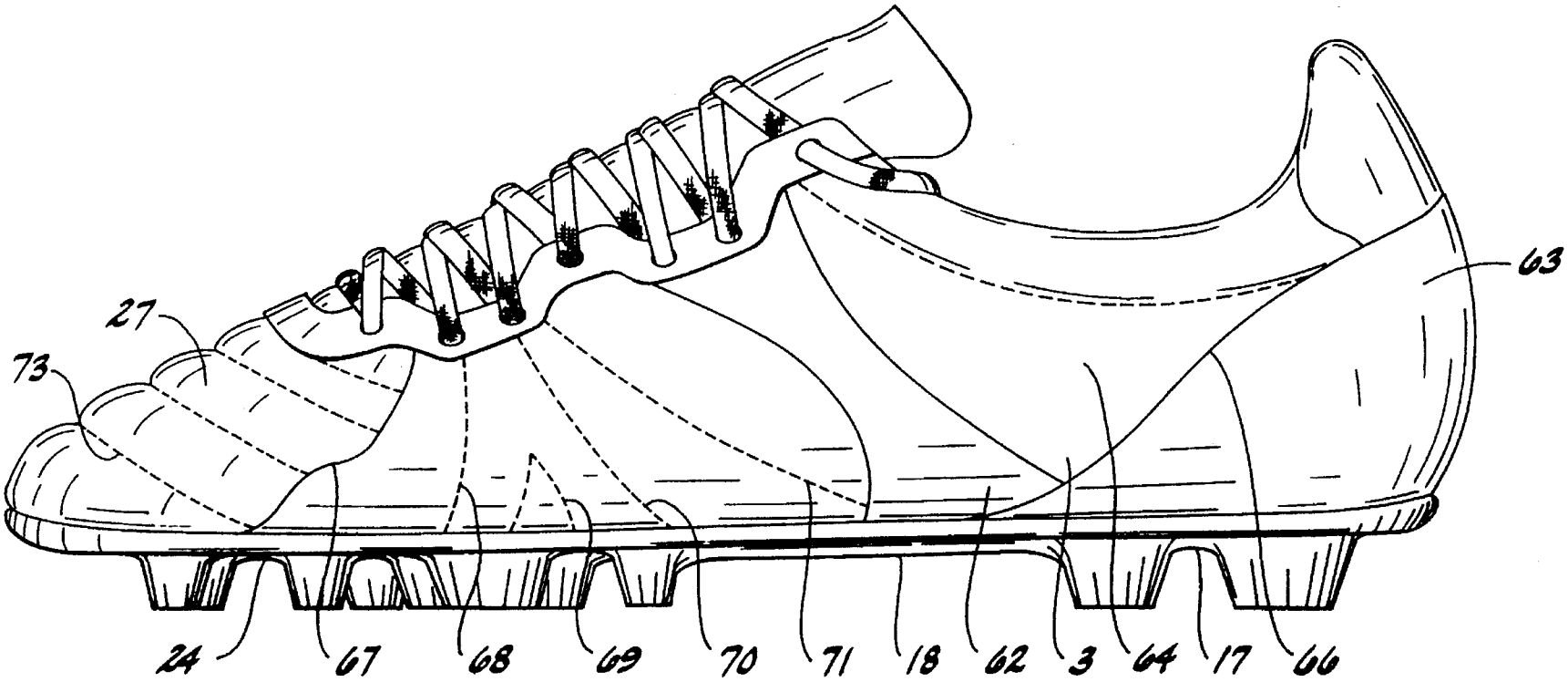
FIG. 2 is a side elevation of the outside of the shoe of the invention as it is worn.
Figure 3:
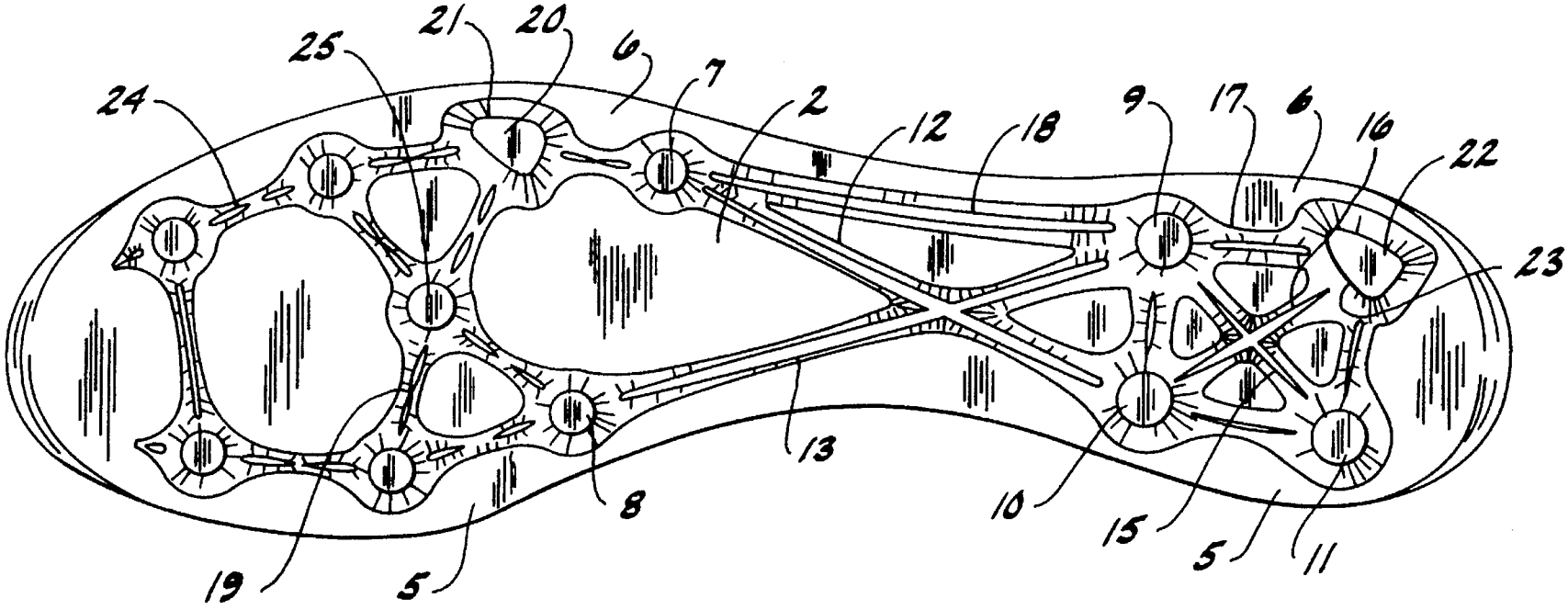
FIG. 3 is a bottom view of the shoe of the invention.

Referring to FIGS. 1–3, there is indicated at 1 the athletic shoe of the invention. The shoe includes a sole 2 and an upper 3. In FIG. 3 there are indicated an inner edge 5 and an outer edge 6 of the sole as the shoe is worn. In the forward portion of the sole toward the toe there are a plurality of forward cleats, including a rearwardmost forward outer cleat 7 adjacent the outer edge of the sole and a rearwardmost forward inner cleat 8 adjacent the inner edge of the sole. There are also a plurality of rearward cleats, including a forwardmost rearward outer cleat 9 adjacent the outer edge of the sole and a forwardmost rearward inner cleat 10 adjacent the inner edge of the sole.

As shown in FIG. 3, the sole also includes a crisscross arch reinforcement having a first intersecting arch rib 12 extending between the rearwardmost forward outer cleat 7 and the forwardmost rearward inner cleat 10, and a second intersecting arch rib 13 extending between the rearwardmost forward inner cleat 8 and the forwardmost rearward outer cleat 9. As shown in FIG. 3, intersecting arch ribs 12 and 13 having a relatively narrow lateral thickness and an intersection having a relatively narrow lateral thickness such that the arch ribs form an X-shaped arch reinforcement. It can also be seen that the intersection itself occupies a length which is small relative to the length between the forward cleats and rearward cleats occupied by the arch reinforcement. These features provide added support to the arch region without excessively increasing the weight and bulk thereof. Intersecting arch ribs 12 and 13 reinforce the portion of the sole under the arch and provide support for the tendons as they are naturally aligned in the foot. Outer sole arch reinforcement rib 18 extends between the rearwardmost forward outer cleat 7 and the forwardmost rearward outer cleat 9. The reinforcement and support provided by arch ribs 12, 13 and 18 result in improved comfort and performance of the shoe.

Indicated in FIG. 3 is a crisscross heel reinforcement having two intersecting heel ribs 15 and 16, each rib extending diagonally between two of the four rearward cleats to reinforce the heel and structurally strengthen the rearward cleats. In particular, first heel rib 15 extends between the forwardmost rearward outer cleat 9 and the rearwardmost rearward inner cleat 11. Second heel rib 16 extends between the forwardmost rearward inner cleat 10 and the triangular rearwardmost rearward outer cleat 22. Additional heel reinforcement ribs 17 forming a square pattern connecting the four rearward cleats provide further strengthening. Heel reinforcement ribs 17 include a third heel rib extending between forwardmost rearward outer cleat 9 and rearwardmost rearward outer cleat 22, a fourth heel rib extending between rearwardmost rearward outer cleat 22 and rearwardmost rearward inner cleat 11, a fifth heel rib extending between rearwardmost rearward inner cleat 11 and forwardmost rearward inner cleat 10, and a sixth heel rib extending between forwardmost rearward inner cleat 10 and forwardmost rearward outer cleat 9.

As shown in FIG. 3, the plurality of forward cleats are interconnected by a series of reinforcement ribs 24 which structurally strengthen the forward cleats and the forward portion of the sole. In the particularly preferred embodiment shown, there are at least seven forward perimeter cleats, including three forward perimeter cleats adjacent the inner edge of the sole and four forward perimeter cleats adjacent the outer edge of the sole. The perimeter cleats are interconnected by forward reinforcement ribs 24 extending between the adjacent cleats around the perimeter of the sole. Strengthening is further accomplished by the forward crisscross reinforcement 19 comprising two intersecting forward ribs. Each intersecting forward rib extends between two forward cleats and intersects at center cleat 25.

It can be seen that one advantage of the reinforcements described herein is that they increase the strength and stability of sole without excessively increasing its weight. The reinforcements, however, further function to increase the traction provided because they extend downwardly from the sole and penetrate the ground similar to cleats when downward pressure is applied. The reinforcements, therefore, provide traction and improved stopping, starting and turning ability in addition to that provided by the cleats themselves.

In the particularly preferred embodiment shown in FIGS. 2 and 3, the size of the reinforcements, that is, their depth, as can be seen by comparison of the reinforcements as viewed at 24, 18 and 17 of FIG. 2, and their lateral thickness, as can be seen by comparison of the reinforcements as viewed at 24, 18 and 17 of FIG. 3, gradually decreases from the heel to the front of the shoe. Accordingly, heel reinforcement ribs 17 are thicker and deeper than reinforcement arch ribs 12, 13 and 18, which are thicker and deeper than forward reinforcement ribs 24 and forward crisscross reinforcement 19. This design feature serves to provide the desired degrees of reinforcement to each area of the sole while not adding excess bulk. Furthermore, an increased amount of flexibility in the sole is advantageously maintained in the toe region relative to the arch region and further relative to the heel region. In an alternative preferred embodiment, heel reinforcement ribs 17 are thicker and deeper than reinforcement arch ribs 12 and 13, which are thicker and deeper than forward reinforcement ribs 24 and forward crisscross reinforcement 19. However, outer sole arch reinforcement 18 may have dimensions the same as or greater than those of the heel reinforcement ribs.

Forward triangular outer cleat 20 is positioned and oriented in such a manner so as to improve the traction and maneuverability the shoe provides the wearer. In particular, cleat 20 has its flat, relatively steep edge 21 aligned generally parallel with the outer edge of the sole at the adjacent outer edge to provide a major edge for pushing off when making turns. The rearwardmost rearward outer cleat 22 is also triangular and has a flat, relatively steep edge 23 aligned diagonally across the sole. Edge 23 provides a major edge to assist stopping. These two triangular cleats are strategically positioned and oriented and cooperate with the other features of the sole to improve the shoe's overall performance. Since each of cleats 20 and 22 are relatively large as compared to the other cleats and to conventional cleats, they improve the comfort of the shoe by dispersing the pressure applied to the foot through the cleat in that location. In this regard, each of cleats 20 and 22 are strategically located in areas where relatively greater and more frequent pressure is applied. It is preferable that the remaining cleats on the shoe are round to facilitate maximum ground penetration.

The reinforced cleat design of the instant invention is preferably manufactured by a two-step molding process. The cleats and interconnected reinforcements are molded as an integral piece of relatively hard rubber or plastic material. The remainder of the sole is then molded around the cleats and interconnected reinforcement from a softer, more flexible, rubber or plastic material. This reinforced cleat design is appropriate for various turf conditions but is especially suited for use on harder, relatively drier natural turf surfaces. The reinforcements between the cleats allow the use of a softer, optionally thinner material for the sole, which is preferred for comfort, light weight and flexibility on relatively harder surfaces. Having six or more forward cleats as this sole does further improves performance on such surfaces where only four cleats, for example, provide inadequate comfort and traction.

Figure 4:
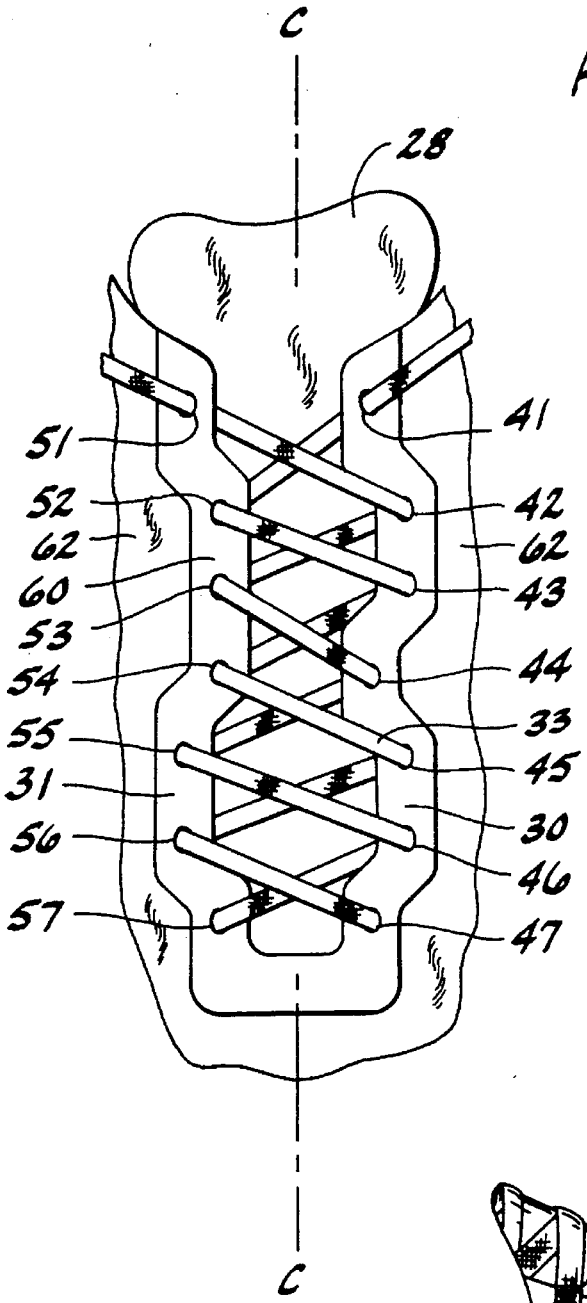
FIG. 4 is a top view of a portion of the shoe of the invention.

Referring now to FIGS. 1 and 4, it can be seen that the shoe upper includes a toe 27, a tongue 28 extending upwardly from the toe, and other features as will be described which advantageously combine with the sole design of the invention to provide improved durability, comfort, strength, maneuverability and overall performance. First side portion 30 and second side portion 31 are opposite each other and overlie the tongue 28. The first side portion overlies the outstep half of the shoe's tongue as the shoe is worn and has a first series of eyelets 41 through 47 for receiving lace 33; the second side portion overlies the instep half of the shoe's tongue as the shoe is worn and has a second series of eyelets 51 through 57 for receiving the lace. The first series of eyelets is asymmetrical to the second series of eyelets with respect to the centerline C—C of the tongue extending up the tongue. In particular, the positions of eyelets 42 and 43, which are directly across the tongue from eyelets 52 and 53, are not symmetrical to the positions of eyelets 52 and 53 with respect to the centerline of the tongue. The relative lateral positions of eyelets 42 and 43 are shifted away from the centerline of the tongue whereas the relative lateral positions of eyelets 52 and 53 are shifted toward the centerline of the tongue. Although the asymmetrical characteristic of the series of eyelets may be embodied in eyelets other than 42/43 and 52/53, this embodiment shown in FIG. 4 is particularly preferred due to the snug fit and comfort provided thereby. Because eyelets 52 and 53 are shifted inward, the eyelets and second side portion 31 at location 60 are located on the top of the raised portion of the foot as the shoe is worn. Eyelets 52 and 53 therefore ride higher on the foot and lay in a flatter orientation on top of the bulge on the instep side of the foot at this location. This asymmetrical feature therefore takes into account the differences between the instep and outstep portion of the foot beneath the laces. This improves the comfort of the shoe because the laces and eyelets direct less pressure into the side of the foot as compared to other arrangements. Furthermore, the eyelets and laces are shifted out of the way of that portion of the foot with which a soccer ball, for example, is often struck, and therefore the eyelets and laces are not forced into the foot thereby. Eyelets 42/43 which mate with eyelets 52/53 are shifted outwardly and therefore provide wider spacing between mating eyelets, allowing for the laces to be drawn more and providing a more secure and comfortable fit. As shown in FIG. 4, eyelets 42 and 43 which are shifted outwardly from the centerline of the tongue and their mating eyelets 52 and 53 which are shifted inwardly toward the centerline of the tongue overlie the upper or top portion of the tongue at the top of the foot. It can also be seen in FIG. 4 that the eyelets overlying the lower or bottom portion of the tongue proximate the toe of the shoe are symmetrical. In particular, each of eyelets 45, 46 and 47 of the first series of eyelets and its respective mating eyelet 55, 56 or 57 are equally spaced from the centerline of the tongue. Although shown here in connection with the cleated sole of the invention, the particular lacing arrangement and asymmetrical series of eyelets of this invention are also applicable for non-cleated athletic shoes.

Referring to FIGS. 1 and 2, there is indicated at 62 a support strap extending from the sole at the front of the heel to eyelets 42 and 43 on the outstep of the shoe and to eyelets 53 and 53 on the instep of the shoe. Support strap 62 may be a single strap which runs down the outside of the shoe, underneath the front of the heel, and up the inside of the shoe. Alternatively, strap 62 may consist of two pieces, each attached to the upper or sole at the front of the heel. Support strap 62 is advantageously engaged by the tightening of the lace through asymmetrical eyelets 42/43 and 52/53 to further enhance the comfort, stability and overall performance of the shoe. The snug fit provided by support strap 62 and the asymmetrical lacing arrangement enhances the ability of the wearer to achieve the maximum traction and maneuverability afforded by the improved sole design of the shoe of this invention.

As can be seen in FIG. 2, the upper of the shoe is comprised of heel support 63 which overlies the main body of the upper 64 and provides added strength, rigidity and durability. Heel support 63 is stitched to the main upper body 64 along stitch line 66. Main upper body 64 extends behind the heel and toward the toe around the inside and outside of the shoe. The material forming the toe section 27 extends from the toe around the inside and outside of the shoe and underneath the main upper body as shown. The toe section and main upper body are stitched along stitch lines 67, 68, 69, 70 and 71 on the outside of the shoe and similarly stitched on the inside of the shoe. The toe section extends from the toe to the mid-foot. The main upper body section 64 extends from the heel forwardly and overlaps at least about one-third, preferably about one-half, of the length of the toe section on each side of the shoe. The overlap between the toe section and main upper body further enhances the strength and durability of the shoe. Stitch lines 73 help to stabilize and strengthen the toe section.

Figure 5:
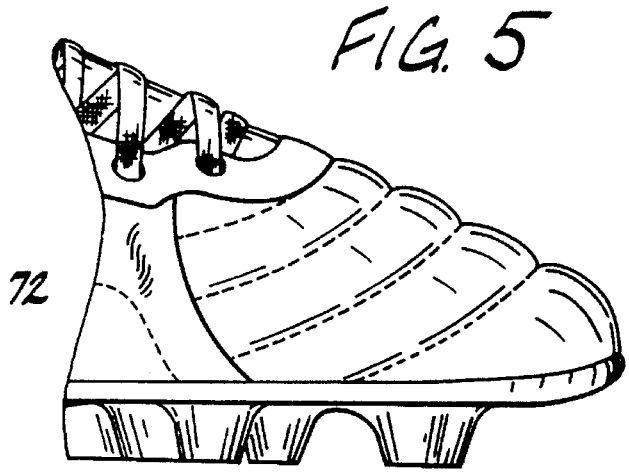
FIG. 5 is a side elevation of the inside of the shoe of the invention as it is worn.

Referring to FIGS. 2 and 5, it can be seen that stitch line 67 on the outside of the shoe is patterned differently from stitch line 72 on the inside of the shoe. These stitch lines take into account the differences between the instep and outstep portions of the shoe at these locations and are designed to provide the improved support and comfortable fit. Stitch line 72 is designed so as to reinforce the upper but not to apply excessive pressure to the side of the foot directly at the ball of the foot. Stitch line 67 is designed so as to reinforce the upper but not to apply excessive pressure to the small toe.

Although specific examples of the present invention and its application are set forth it is not intended that they are exhaustive or limiting of the invention. These illustrations and explanations are intended to acquaint others skilled in the art with the invention, its principles, and its practical application, so that others skilled in the art may adapt and apply the invention in its numerous forms, as may be best suited to the requirements of a particular use.

I claim:

1. A cleated athletic shoe having an upper and a sole, the sole having an inner and an outer edge and an arch region as the shoe is worn and the sole comprising:

a plurality of forward cleats, including a rearwardmost forward outer cleat adjacent the outer edge of the sole and a rearwardmost forward inner cleat adjacent the inner edge of the sole;

a plurality of rearward cleats, including a forwardmost rearward outer cleat adjacent the outer edge of the sole and a forwardmost rearward inner cleat adjacent the inner edge of the sole; and a crisscross arch reinforcement on the sole consisting only of slender first and second intersecting arch ribs having an intersection in the arch region, said first arch rib extending in a straight line between said rearwardmost forward outer cleat and said forwardmost rearward inner cleat and said second arch rib extending in a straight line between said rearwardmost forward inner cleat and said forwardmost rearward outer cleat, said first and second arch ribs having a relatively narrow lateral thickness as compared to the length of said arch ribs and said intersection having a relatively narrow lateral thickness as compared to the length of said arch ribs such that the arch ribs form an X-shaped arch reinforcement to provide added support to the arch region without excessively increasing the weight and bulk thereof, said arch ribs of said X-shaped reinforcement being slender and being raised from the sole such that said reinforcement penetrates the ground when downward pressure is applied as the shoe is worn and thereby provides lateral traction and supplements traction provided by the cleats.

2. The cleated athletic shoe of claim 1, the sole further comprising an outer sole reinforcement comprising a rib extending between the rearwardmost forward outer cleat and the forwardmost rearward outer cleat.

3. The cleated athletic shoe of claim 1, the sole comprising a triangular forward outer cleat adjacent the outer edge of the sole having a flat edge aligned generally parallel to said outer edge of the sole.

4. The cleated athletic shoe of claim 1, the sole comprising a triangular rearwardmost rearward outer cleat having a flat edge aligned diagonally across the sole.

5. The cleated athletic shoe of claim 1 wherein the upper has a toe, a tongue extending upwardly from said toe and having a centerline extending upwardly from said toe and having an outstep half and an instep half as the shoe is worn, said upper comprising first and second opposite side portions which overlie the tongue and comprise a first series of eyelets for receiving a lace on the first side portion and a second series of eyelets for receiving the lace on the second side portion, said first series of eyelets overlying the outstep half of the tongue and said second series of eyelets overlying the instep half of the tongue, said first series of eyelets comprising two eyelets which mate with two eyelets of the second series of eyelets, said two eyelets of the first series being shifted outwardly from the centerline of the tongue such that they are farther from said centerline relative to said two eyelets of the second series of eyelets which are shifted inwardly toward the centerline of the tongue.

6. The cleated athletic shoe of claim 1 wherein said shoe has a heel, a mid-foot, a toe and two sides as the shoe is worn, the upper comprising a toe section extending from the toe to the mid-foot and having a length extending along each side of the shoe, the upper further comprising a main body section extending from the heel forwardly and overlapping at least about one-third of the length of the toe section on each side of the shoe.

7. A cleated athletic shoe having an upper and a sole, the sole having an inner and an outer edge and an arch region as the shoe is worn and the sole comprising:

a plurality of forward cleats, including a rearwardmost forward outer cleat adjacent the outer edge of the sole and a rearwardmost forward inner cleat adjacent the inner edge of the sole;

a plurality of rearward cleats, including a forwardmost rearward outer cleat adjacent the outer edge of the sole and a forwardmost rearward inner cleat adjacent the inner edge of the sole;

a crisscross arch reinforcement on the sole having first and second intersecting arch ribs having an intersection in the arch region, said first arch rib extending between said rearwardmost forward outer cleat and said forwardmost rearward inner cleat and said second arch rib extending between said rearwardmost forward inner cleat and said forwardmost rearward outer cleat, said first and second arch ribs having a relatively narrow lateral thickness as compared to the length of the arch ribs and said intersection having a relatively narrow lateral thickness as compared to the length of the arch ribs such that the arch ribs form an X-shaped arch reinforcement to provide added support to the arch region without excessively increasing the weight and bulk thereof; and four of said rearward cleats including said forwardmost rearward outer cleat, said forwardmost rearward inner cleat, a rearwardmost rearward outer cleat, and a rearwardmost rearward inner cleat, and a crisscross heel reinforcement having first and second intersecting heel ribs, said first heel rib extending between said forwardmost rearward outer cleat and said rearwardmost rearward inner cleat, said second heel rib extending between said forwardmost rearward inner cleat and said rearwardmost rearward outer cleat.

8. The cleated athletic shoe of claim 5, the sole comprising a third heel rib extending between said forwardmost rearward outer cleat and said rearwardmost rearward outer cleat, a fourth heel rib extending between said rearwardmost rearward outer cleat and said rearwardmost rearward inner cleat, a fifth heel rib extending between said rearwardmost rearward inner cleat and said forwardmost rearward inner cleat, and a sixth heel rib extending between said forwardmost rearward inner cleat and said forwardmost rearward outer cleat.

9. The cleated athletic shoe of claim 6, the sole comprising at east four forward cleats and a forward crisscross reinforcement comprising two intersecting forward ribs, each rib extending between two of said forward cleats.

10. A cleated athletic shoe having an upper and a sole, the sole having an inner and an outer edge as the shoe is worn and the sole comprising:

a plurality of forward cleats, including a rearwardmost forward outer cleat adjacent the outer edge of the sole and a rearwardmost forward inner cleat adjacent the inner edge of the sole;

a plurality of rearward cleats, including a forwardmost rearward outer cleat adjacent the outer edge of the sole and a forwardmost rearward inner cleat adjacent the inner edge of the sole;

a crisscross arch reinforcement on the sole having first and second intersecting arch ribs, said first arch rib extending between said rearwardmost forward outer cleat and said forwardmost rearward inner cleat, said second arch rib extending between said rearwardmost forward inner cleat and said forwardmost rearward outer cleat;

four of said rearward cleats including said forwardmost rearward outer cleat, said forwardmost rearward inner cleat, a rearwardmost rearward outer cleat, and a rearwardmost rearward inner cleat, and a crisscross heel reinforcement having first and second intersecting heel ribs, said first heel rib extending between said forwardmost rearward outer cleat and said rearwardmost rearward inner cleat, said second heel rib extending between said forwardmost rearward inner cleat and said rearwardmost rearward outer cleat;

a third heel rib extending between said forwardmost rearward outer cleat and said rearwardmost rearward outer cleat, a fourth heel rib extending between said rearwardmost rearward outer cleat and said rearwardmost rearward inner cleat, a fifth heel rib extending between said rearwardmost rearward inner cleat and said forwardmost rearward inner cleat, and a sixth heel rib extending between said forwardmost rearward inner cleat and said forwardmost rearward outer cleat;

at least four forward cleats and a forward crisscross reinforcement comprising two intersecting forward ribs, each rib extending between two of said forward cleats; and a forward cleat located at the intersection of said intersecting forward ribs.

11. The cleated athletic shoe of claim 10, the sole comprising seven forward perimeter cleats including three forward cleats adjacent the inner edge of the sole and four forward cleats adjacent the outer edge of the sole, and a forward reinforcement rib extending around the perimeter between each pair of adjacent perimeter forward cleats.

12. The cleated athletic shoe of claim 11 wherein said forward reinforcement ribs, said arch ribs and said heel ribs have average thicknesses and depths, the average thickness and depth of said forward reinforcement ribs being less than the average thickness and depth of the arch ribs and the average thickness and depth of the arch ribs being less than the average thickness and depth of the heel ribs.

13. An athletic shoe comprising an upper having a toe, a tongue extending upwardly from said toe, the tongue having a bottom portion proximate the toe and a top portion above the bottom portion, the tongue having a centerline extending upwardly from said toe and having an outstep half and an instep half as the shoe is worn, and a sole, said upper comprising first and second opposite side portions which overlie the tongue and comprising a first series of eyelets for receiving a lace on the first side portion and a second series of eyelets for receiving the lace on the second side portion, said first series of eyelets overlying the outstep half of the tongue and said second series of eyelets overlying the instep half of the tongue;

said first series of eyelets comprising two eyelets overlying the top portion of the tongue which mate with two eyelets of the second series of eyelets overlying the top portion of the tongue directly across the tongue from said two eyelets of the first series, said two eyelets of the first series being shifted outwardly from the centerline of the tongue such that they are farther from said centerline relative to said two eyelets of the second series of eyelets which are shifted inwardly toward the centerline of the tongue;

said first series of eyelets further comprising eyelets overlying the bottom portion of the tongue, each of which eyelet has a mating eyelet of the second series of eyelets overlying the bottom portion of the tongue, each eyelet of the first series overlying the bottom portion of the tongue and its mating eyelet of the second series of eyelets being equally spaced from the centerline of the tongue.

14. A cleated athletic shoe having an upper and a sole, the sole having an inner and an outer edge as the shoe is worn and the sole comprising:

a plurality of forward cleats, including a rearwardmost forward outer cleat adjacent the outer edge of the sole, a rearwardmost forward inner cleat adjacent the inner edge of the sole, and a triangular forward outer cleat adjacent the outer edge of the sole having a flat edge aligned generally parallel to said outer edge of the sole;

four rearward cleats, including a forwardmost rearward outer cleat, a forwardmost rearward inner cleat, a rearwardmost rearward outer cleat, and a rearwardmost rearward inner cleat, said rearwardmost rearward outer cleat being triangular;

a crisscross arch reinforcement on the sole having first and second intersecting arch ribs, said first arch rib extending between said rearwardmost forward outer cleat and said forwardmost rearward inner cleat, said second arch rib extending between said rearwardmost forward inner cleat and said forwardmost rearward outer cleat;

an outer sole arch reinforcement comprising a rib extending between the rearwardmost forward outer cleat and the forwardmost rearward outer cleat; and a crisscross heel reinforcement having first and second intersecting heel ribs, said first heel rib extending between said forwardmost rearward outer cleat and said rearwardmost rearward inner cleat, said second heel rib extending between said forwardmost rearward inner cleat and said triangular rearwardmost rearward outer cleat.

15. The cleated athletic shoe of claim 14, the sole comprising a third heel rib extending between said forwardmost rearward outer cleat and said rearwardmost rearward outer cleat, a fourth heel rib extending between said rearwardmost rearward outer cleat and said rearwardmost rearward inner cleat, a fifth heel rib extending between said rearwardmost rearward inner cleat and said forwardmost rearward inner cleat, and a sixth heel rib extending between said forwardmost rearward inner cleat and said forwardmost rearward outer cleat.

16. The cleated athletic shoe of claim 15, the sole comprising seven forward perimeter cleats including three forward perimeter cleats adjacent the inner edge of the sole and four forward perimeter cleats adjacent the outer edge of the sole, and a forward reinforcement rib extending between each adjacent pair of perimeter forward cleats; and said forward reinforcement ribs, said arch ribs and said heel ribs having average thicknesses and depths, the average thickness and depth of said forward reinforcement ribs being less than the average thickness and depth of the arch ribs and the average thickness and depth of the arch ribs being less than the average thickness and depth of the heel ribs.

17. The cleated athletic shoe of claim 14 wherein the upper comprises a toe, a tongue extending upwardly from said toe, the tongue having a centerline extending upwardly from said toe and having an outstep half and an instep half as the shoe is worn, said upper comprising first and second opposite side portions which overlie the tongue, a first series of eyelets for receiving a lace on the first side portion and a second series of eyelets for receiving the lace on the second side portion, said first series of eyelets overlying the outstep half of the tongue and said second series of eyelets overlying the instep half of the tongue, said first series of eyelets comprising two eyelets which mate with two eyelets of the second series of eyelets, said two eyelets of the first series being shifted outwardly from the centerline of the tongue such that they are farther from said centerline relative to said two eyelets of the second series of eyelets which are shifted inwardly toward the centerline of the tongue.

* * * * *